166-274 SR
8/14/84 XR 4,465,137

United States Patent [19]

Sustek, Jr. et al.

[11] Patent Number: 4,465,137

[45] Date of Patent: Aug. 14, 1984

[54] VARYING TEMPERATURE OIL RECOVERY METHOD

[75] Inventors: Alvin J. Sustek, Jr., Houston; Wilbur L. Hall, Bellaire; Thomas S. Teasdale, Houston, all of Tex.; John F. Wiechel, Columbus, Ohio

[73] Assignee: Texaco Inc., White Plains, N.Y.

[21] Appl. No.: 392,415

[22] Filed: Jun. 25, 1982

[51] Int. Cl.[3] ..... E21B 43/24

[52] U.S. Cl. ..... 166/272; 166/274

[58] Field of Search ..... 166/272, 273, 303

[56] References Cited

U.S. PATENT DOCUMENTS

| | | | |
|---|---|---|---|
| 2,862,558 | 12/1958 | Dixon | 166/272 |
| 3,027,942 | 4/1962 | Willman | 166/272 |
| 3,155,160 | 11/1964 | Craig et al. | 166/303 |
| 3,360,045 | 12/1967 | Santourian | 166/11 |
| 3,421,583 | 1/1969 | Koons | 166/272 |
| 3,434,541 | 3/1969 | Cook et al. | 166/256 |
| 3,439,743 | 4/1969 | Wyllie et al. | 166/272 |
| 3,714,985 | 2/1973 | Bayless | 166/303 |
| 4,177,752 | 12/1979 | Brown et al. | 166/263 |
| 4,392,530 | 7/1983 | Odeh et al. | 166/272 |

FOREIGN PATENT DOCUMENTS

| | | | |
|---|---|---|---|
| 933343 | 9/1973 | Canada | 166/272 |

OTHER PUBLICATIONS

*Synthetic Fuels*, "Status of Technology for the In-Situ Recovery of Bitumen From Oil Sands", 3/74, p. 3-1.

*Primary Examiner*—Stephen J. Novosad
*Assistant Examiner*—Mark J. Del Signore
*Attorney, Agent, or Firm*—Carl G. Ries; Jack H. Park; Harold J. Delhommer

[57] ABSTRACT

The present invention is a sequenced method of increasing the injectivity of oil bearing formations and increasing hydrocarbon recovery. The method of the invention is initiated by injecting an aqueous fluid at an ambient temperature into the formation through an injection well while concurrently recovering fluid at a production well. The first injection stage is followed by the injection of fluid of gradually increasing temperature until a temperature of about 75°-100° C. is reached. Finally, steam is injected into the formation.

3 Claims, 4 Drawing Figures

FLUID PRODUCTION - EXAMPLE 4

VARYING TEMPERATURE OIL RECOVERY METHOD

FIELD OF THE INVENTION

The present invention concerns a water and steam drive oil recovery method. More particularly, the invention relates to a sequenced method of injecting an aqueous fluid having a relatively low temperature followd by a fluid having a relatively higher temperature, followd by steam for increasing injectivity and the recovery of viscous hydrocarbons from oil bearing formations.

PRIOR ART

It is well recognized that primary hydrocarbon recovery techniques may recover only a minor portion of the petroleum products present in the formation. This is particularly true for reservoirs containing viscous crudes. Thus, numerous secondary and tertiary recovery techniques have been suggested and employed to increase the recovery of hydrocarbons from the formations holding them in place. Thermal recovery techniques have proven to be effective in increasing the amount of oil recovered from the ground. Waterflooding and steamflooding have proven to be the most successful oil recovery techniques yet employed in commercial practice. However, the use of these techniques may still leave up to 70% to 80% of the original hydrocarbons in place.

Furthermore, when reservoirs containing viscous oil are flooded, problems related to the formation of highly viscous oil banks can be frequently encountered. Conditions may exist in the reservoir where more viscous oil is encountered and due to formation materials and porosity, injectivity drastically decreases, making it difficult to inject sufficient fluid and heat into the formation. As a result, these viscous oil banks may solidify to the point where fluid flow cannot be sustained without increasing injection pressure far beyond maximum pressure restraints and damaging the reservoir.

Several methods have been developed which involve a combination of steam and waterflooding such as U.S. Pat. Nos. 3,360,045 and 4,177,752. But these methods generally begin with steam injection followed by waterflooding. U.S. Pat. No. 3,360,045 discloses a steam injection process followed by hot water flooding along with a polymeric thickening agent contained within the water injected. U.S. Pat. No. 4,177,752 describes a multi-step process in which steam is initially injected into the formation before the completion of a third well between the injection and production wells. After producing through the third well for a time, hot water is injected through the third well,. Such methods may leave a large amount of oil in place in viscous formations such as tar sands and can frequently be further thwarted by the formation of viscous oil banks within the formation that are highly resistant to oil flow.

SUMMARY OF THE INVENTION

The present invention comprising a specific sequence of steps increases injectivity of a formation a substantial degree while permitting the recovery of a greater quantity of petroleum than that possible with ordinary steam and water drives. At least two wells, one an injection well and the second a production well, are required for the practice of the invention. Of course, more injection and production wells may be completed to the formation and employed in the practice of the invention.

The invention sequence is initiated by the injection into the formation of an aqueous fluid at ambient temperature. After a suitable period of ambient temperature fluid injection, a heated aqueous fluid is injected into the formation. This is immediately followed by steam injection. Produced hydrocarbons are recovered through the production well during all three injection stages.

In its most preferred embodiment, the temperature of the injected fluid which is essentially water is gradually increased over lengthy time periods from ambient temperature to a hot temperature of about 75°–100° C. The preferred embodiment also includes a gradual increase in steam quality from a low quality steam at the initiation of steam injection to a later, high quality steam. This gradual transition to progressively hotter and hotter fluid, and higher quality steam, maintains communication between the injection and production wells and prevents the formation of distinct, thick oil banks even in formations holding highly viscous petroleum. In addition, a hydrocarbon solvent may be injected into the formation before the injection of steam to improve oil mobility and increase recovery. The present invention has particular application to heavy oil and tar sand reservoirs.

DETAILED DESCRIPTION

Figure 1:
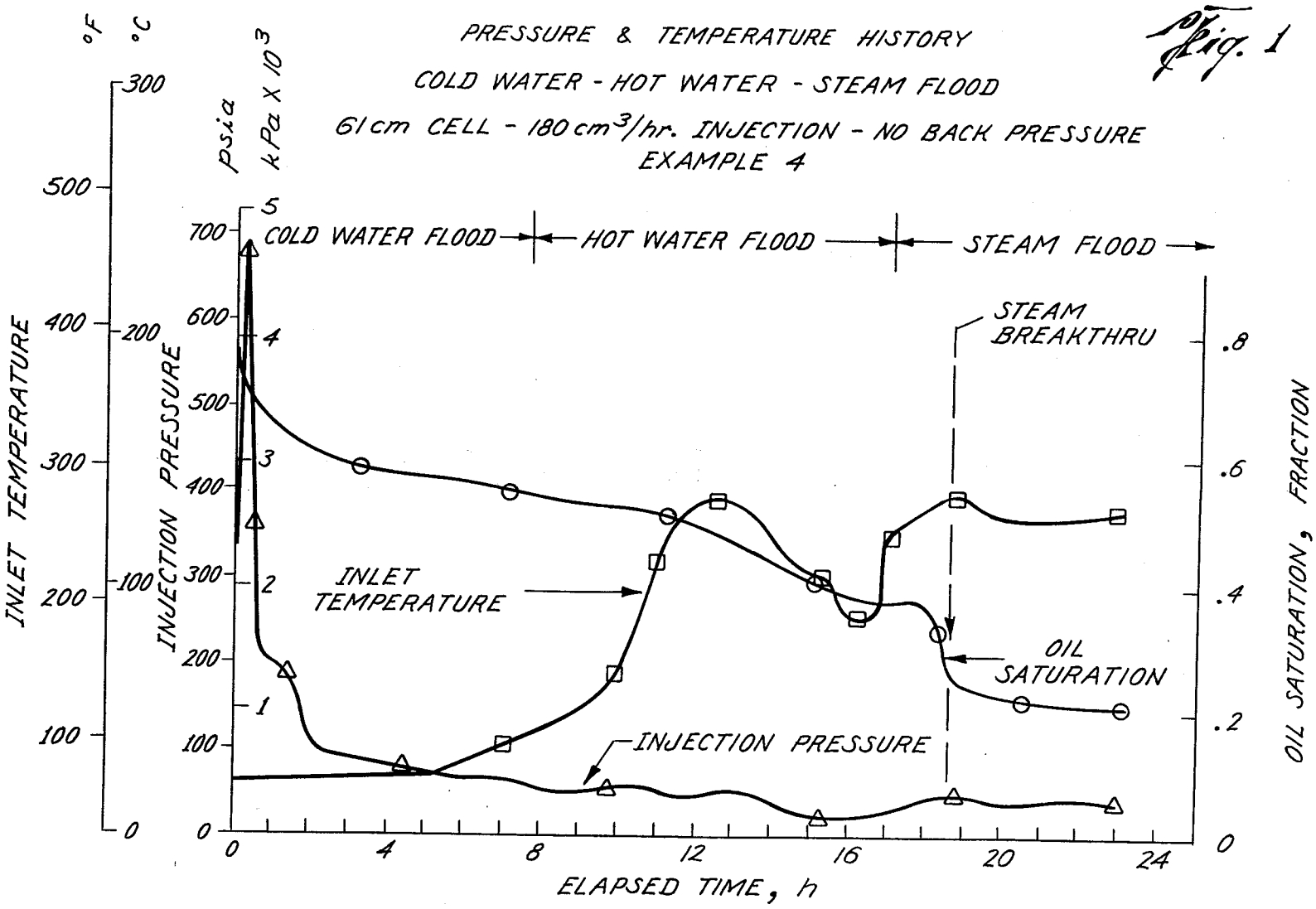
FIG. 1 is a graph illustrating the pressures, temperatures and residual oil saturation of the invention sequence as carried out in Example 4.

The present invention substantially increases formation injectivity and provides enhanced recovery of light and heavy hydrocarbons. It is particularly useful during recovery of viscous hydrocarbons, including tar sands, where viscous oil is likely to coagulate and form immobile oil banks in the formation. The several stage process maintains communication and permits the driving of viscous oil towards the production well without creating viscous oil banks or exceeding pressures which might damage the formation.

The first injection stage consists of an aqueous fluid essentially comprised of water at an ambient temperature. Such water, normally at a temperature of about 10° C. to about 40° C., is injected into the formation by an injection well to aid in establishing a network of flow paths through the reservoir matrix and any local concentrations of highly viscous oil. It is thought that the ambient temperature water initially displaces connate water as well as gas contained in the reservoir.

The second injection phase of hot water enlarges the communication paths which have been established through the reservoir matrix and begins to mobilize and displace petroleum trapped in the formation. In the preferred practice of this invention, the temperature of the injected water is gradually increased from the ambient temperature at which the water is initially injected.

During this gradual transition to progressively hotter and hotter water over a lengthy period of time, an increasing amount of oil is mobilized and displaced towards the production well or wells systematically reducing the oil saturation to the ultimate hot water residual saturation for the specific crude and reservoir (0.3 to 0.6 Sor for certain heavy oils). A slow gradual increase in injection water temperature is important to avoid the formation of a distinct, thick oil bank which may become immobile and thwart secondary recovery efforts. It is desired that the water temperature be gradually increased to a final temperature of about 85° C. to about 100° C.

A hydrocarbon solvent may be optionally injected before the injection of steam in the third step to improve hydrocarbon viscosity. The preferred injection time of the solvent is after hot water injection and before steam injection, but good results may also be obtained when a solvent is injected before or during hot water injection. Such solvent injection substantially aids in establishing and maintaining communication in tar sands. Preferred hydrocarbon solvents include naptha and a $C_5$–$C_6$ cut of crude oil.

The third step of the injection sequence involves the injection of steam through the injection well. It is preferred that the steam initially injected be of a low quality (abut 10% to about 25% quality). Steam having a low ratio of vapor to water is initially preferred in the practice of the invention so as to continue the gradual transition of increased heat being injected into the formation. It is also preferred that the steam quality be gradually increased until a steam quality of about 65% to about 90% is reached. Produced fluids are recovered concurrently with all three injection steps.

The decision on when to change from one injection step to another is dependent upon many factors and varies considerably from formation to formation. A few of the factors which must be considered in determining the length of the injection stages are the pore volume and porosity of the field, the stability and character of the injection pressure, trends in injection pressure, the vertical conformance of the formation, and production characteristics including the rate of production of the formation and the temperature response of the production well.

It is generally desirable to inject from about one to about two pore volumes of fluid into the reservoir. Continuing to increase the quantity of fluid injected until a balance is reached between the amount of fluid being injected and the quantity of fluid produced may also be desirable.

In practice, it has been found that ambient temperature injection should continue at a constant, limited injection pressure for about two to about four weeks. After the two to four week ambient temperature fluid injection stage, it is preferred to increase the injected fluid temperature at a rate of about 0.5° to about 2.0° C. every week until near steam conditions are reached. The rapidity in change of fluid temperature is an inverse function of the viscosity of the in place crude. The hot fluid should be injected over a period of about two to about twelve months in a quantity ranging from about 0.05 to about 0.85 pore volumes, preferably about 0.05 to about 0.3 pore volumes.

During the gradual transition to hotter aqueous fluid, injectivity of the formation as well as the fluid produced should be constantly monitored to determine if the pressure or quantity of the injected fluid should be modified. If injectivity problems occur, restorative measures such as anti-dispersion additives, mud acids or clay stabilizers should be employed.

The transition to steam should be made only when the producing well or wells demonstrate substantial thermal response from the hot fluid injection. The increase in steam quality from 0% of the range of about 65% to about 90% should occur over a couple of months with the injection of about 0.1 to about 0.3 pore volumes of steam. Thereafter, steam injection should be continued until the costs of steam injection outweigh the value of the produced oil cut.

If an untenable injectivity loss results during the steam injection phase, steam injection should be halted and hot water injection resumed. Further steam injection should await substantial additional thermal response shown by the producing well. In practice, this may mean hot water and steam injection stages of several months each.

In addition to being employed as the principal method of enhanced oil recovery for a reservoir, the present invention may also be utilized in conjunction with other enhanced recovery techniques in the event plugging or detrimental viscous oil banking occurs. Blockage of the formation as a result of viscous oil banking can be a serious problem in conventional steam operations. But the present invention through its injection of ambient temperature water and water of gradually increasing temperature can relieve the problem of viscous oil banking by channeling through or around the zone where plugging occurs. A communicative link between injection and production wells can generally be re-established without resorting to drastically increased injection pressures which may damage the reservoir. If such remedial treatment fails to solve the plugging of viscous oil banking, a non-condensable gas may be injected to further aid in establishing communication. Then the injection sequence of the invention should be repeated. Suitable non-condensable gases include carbon dioxide, nitrogen, methane, combustion gases and air.

It has also been discovered that total oil recovery may be increased if back pressure is applied to the formation through the production well. A substantial back pressure will restrict the expanding water and steam injection zones, increasing residence time and insuring that injected hot water will remain in the liquid phase for a longer time. Properly applied back pressure will also inhibit water and steam breakthrough and maintain the advancing water and steam front in a more uniform manner.

Application of back pressure, however, is not universally recommended. Reservoir conditions such as porosity and high vertical nonconformance as well as production economics may make its use disadvantageous. Restricting water and steam expansion through back pressure substantially stretches out injection and flooding times. Consequently, larger quantities of thermal energy must be injected into the reservoir. The additional thermal energy loss during this period may make the additional recovered oil economically unattractive.

The invention is better understood by reference to the following examples. These examples are offered for illustrative purposes only and should not be construed as limiting the scope of the invention.

EXPERIMENTAL EVALUATION

For the purpose of demonstrating the operation and advantages of the present sequence injection process, the following laboratory experiments and field tests were performed. Comparisons are made between the present invention and a recovery process employing steam injection only.

For the laboratory tests, an experimental apparatus was set up employing a linear flow cell, a steam generator, constant rate mercury displacement water feed pumps and a production condensing and collecting system. For Examples 1–3 the linear cell was approximately 17.8 centimeters in length with a cross sectional area of about 9.5 square centimeters and a bulk volume of approximately 169 cubic centimeters. Larger cells were employed for Examples 4–5. They measured approximately 61 centimeters in length with a cross sectional area of 27.1 square centimeters and a bulk volume of 1653 cubic centimeters. Linear flow cells 30 centimeters long with a cross sectional area of 10.0 square centimeters were employed in the tar sand tests of Examples 6–12. Example 13 is an additional laboratory test employing highly viscous crude from a Santa Barbara County, California field. The results of an actual field test in Anderson County, Texas are reported in Example 14.

EXAMPLE 1

The 17.8 centimeter linear flow cell was packed with ground core material from a field in Anderson County, Texas which produces crude oil of about 18.5° API. Following saturation of the cell with fresh water, the water was then displaced from the cell by crude oil from the Anderson County field having a gravity of 18.5° API to establish the initial oil saturation.

The sand pack was first flooded with ambient temperature water of approximately 20° to 25° C., which was followed by a hot water flood at about 82° C. and then a steam flood without any back pressure beyond atmospheric pressure. Oil saturation was lowered from 0.86 to a very good residual saturation of 0.277.

EXAMPLES 2–3

For both examples, the same crude of Example 1 was mixed with fresh water and lightly crushed core samples before packing the cell. The water in Example 3 was furnished by a 1% potassium chloride solution intended to check into evidence of water sensitive clays. As shown by Table 1, treatment conditions for Examples 2 and 3 were nearly identical except that Example 2 was treated according to the sequence method of the present invention, and Example 3 was injected with steam only. The cell of Example 2 produced a much greater quantity of oil through the practice of the present invention when compared to the steam only run of Example 3. Table 1 should be examined for specific details.

EXAMPLES 4–5

The larger 61 centimeter cells were packed with lightly crushed core samples from the Anderson County, Texas field of Example 1. A thin layer of 15–20 mesh sand was placed at each end of the cell to restrict particle motion and to simulate gravel packing used in the Anderson County field. The initial oil saturation of Examples 4 and 5 was created by saturating the crushed cores with fresh water and displacing the water with fresh 18.5° API crude from the Anderson County field to give an initial oil saturation of 0.81 for both examples.

Figure 2:
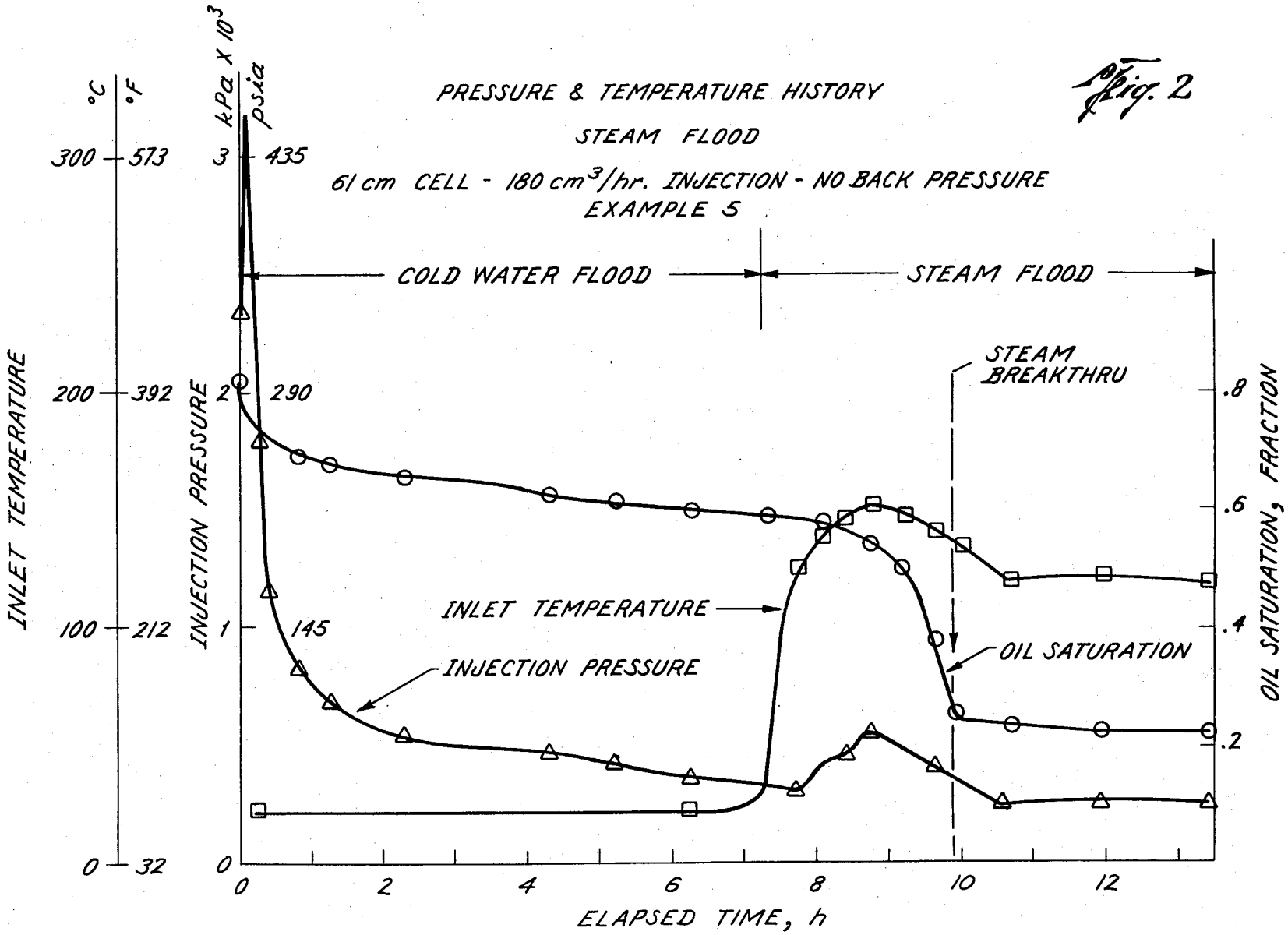
FIG. 2 is a graph illustrating the pressures, temperatures and residual oil saturation of the invention sequence as carried out in Example 5.

Processing conditions were very similar for both examples except that the hot water flooding was omitted from Example 5. The pressure and temperature history of the invention sequence of Example 4 is shown in FIG. 1. The same information for Example 5 is given in FIG. 2. It should be noted in FIG. 1 that little additional reduction of residual oil saturation occurs after steam breakthrough with additional time. This is the point at which emulsion formation begins.

Figure 3:
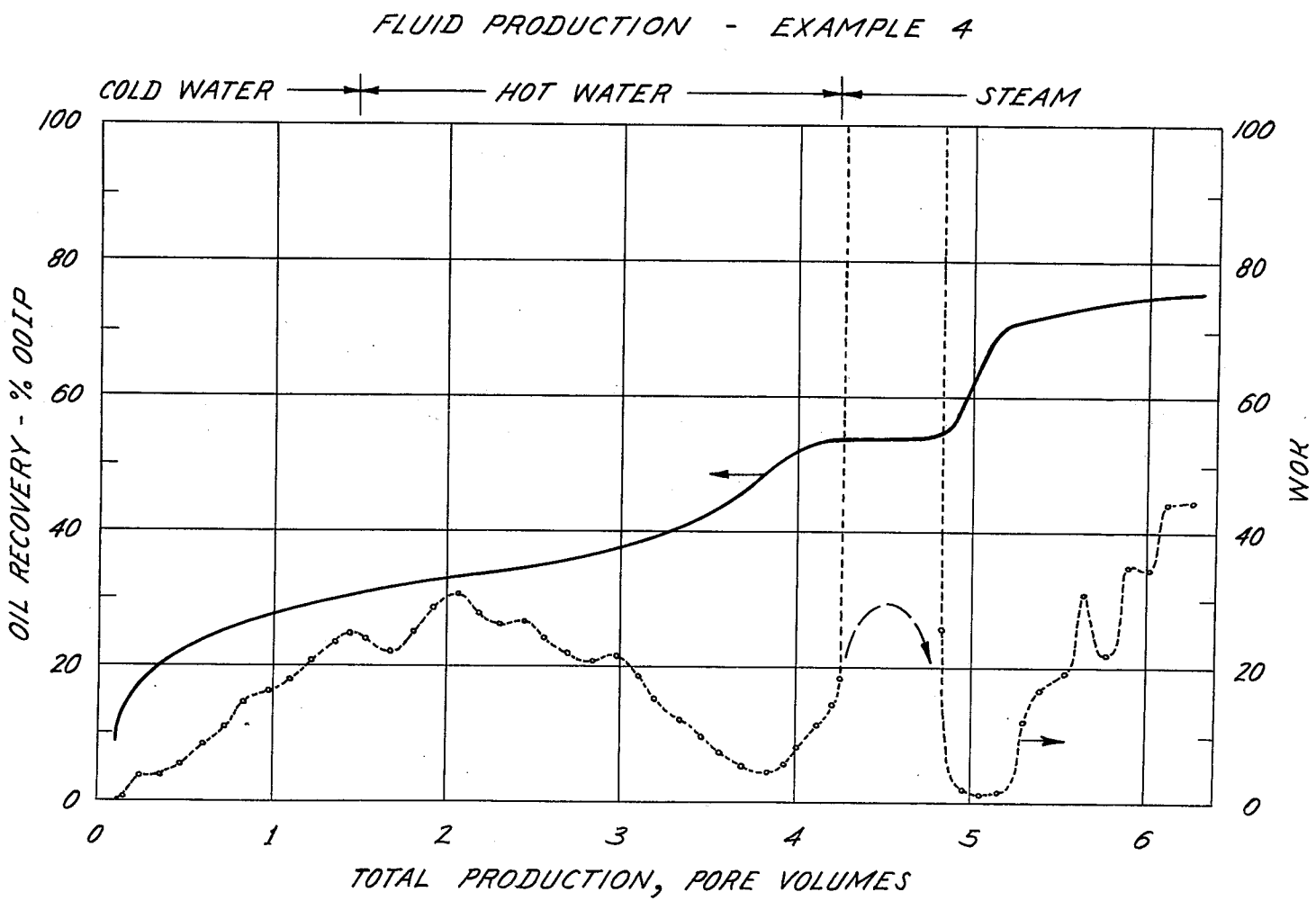
FIG. 3 is a graph illustrating total oil recovery and the variation in water-oil ratios of the invention sequence of Example 4.

FIG. 3 illustrates total oil recovery and water-oil ratio variation with the injection procedure of Example 4. Total oil recovery in Example 4 was below optimum recovery because the sand pack was allowed to cool between hot water injection and steam injection. FIG. 3 shows this clearly with the temporary, but substantial increase in water-oil ratio and the lack of increased oil recovery at the beginning of steam injection in Example 4. When steam is injected immediately following hot water injection, yields are greater. But despite the interrupted injection period in Example 4, Example 4 still yielded a greater recovery of oil, 445 cubic centimeters compared to 426 cubic centimeters, and a lower residual oil saturation. See Table I.

EXAMPLES 6–12

The invention injection sequence was also tested with Canadian tar sands in Examples 6–12. Linear flow cells 30 centimeters long with a cross sectional area of 10 square centimeters were hydraulically packed with mined material from Great Canadian Oil Sands. Porosity of the sand packs varied from 0.38 to 0.42 and initial oil saturation varied from 0.60 to 0.78.

As seen in Table II, the practice of the invention with ambient temperature water injection, followed by hot water injection and steam injection produced the lowest residual oil saturations as per Examples 6–8. When the cells were allowed to cool after hot water injection and before steam injection (Examples 9–10), the residual oil saturations were very similar to the higher residual oil saturations occurring after injection by steam only (Examples 11–12).

EXAMPLE 13

The sequence method of the present invention was also tested in the laboratory on viscous oil cores taken from a Santa Barbara County, California field in a manner similar to the previous examples. The cold water-hot water-steam injection sequence substantially improved injectivity over a steam only injection and lowered residual oil saturation to 0.15. An overall temperature increase was also possible before steam injection without banking significant amounts of oil. Additionally, a light hydrocarbon solvent was injected into the formation between the hot water and steam stages. The solvent was predominantly a $C_5$–$C_6$ natural gasoline cut of crude oil. The additive was very efficient in mobilizing the oil which had not been preheated enough by the hot water injection to adequately reduce viscosity.

EXAMPLE 14

The present invention was tried in the Carrizo Sands of the Anderson County, Texas field of the laboratory examples. The primary purpose of the field test was to improve communication between injection and production wells. The field tests were successful in substantially increasing injectivity.

Ambient temperature water injection was initiated with an initial injectivity of about 3.2 cubic meters per day (20 barrels of water per day) at 3447.4 kilopascals (500 psig). Bottom hole pressure was extremely poor. After acidizing the well with hydrochloric acid the injection rate improved to about 11.9 cubic meters per day (75 barrels of water per day). A second acid treatment with mud acid was applied about two weeks after initial injection increasing the injection rate to 23.8 cubic meters per day (150 barrels of water per day). Cold water injection continued at this rate until hot water injection was initiated two months after initial injection. Hot water injection was undertaken at about 66° C. which improved injectivity immediately to about 160 cubic meters per day (1000 barrels of water per day) for about one month before injectivity drastically fell to a level near the cold water injectivity about three months after initial injection. However, injectivity improved from the low value of about 32 cubic meters per day (200 barrels of water per day) during the next two months as communications were improved with the producing wells.

The transition to steam was implemented five months after initial injection. Steam quality was slowly increased through the design criteria of about 70% quality after approximately 1 more month. Steam injection was continued for a total of about 4 months at a rate of about 95.4 cubic meters per day (600 barrels of water per day) at 70% quality.

Figure 4:
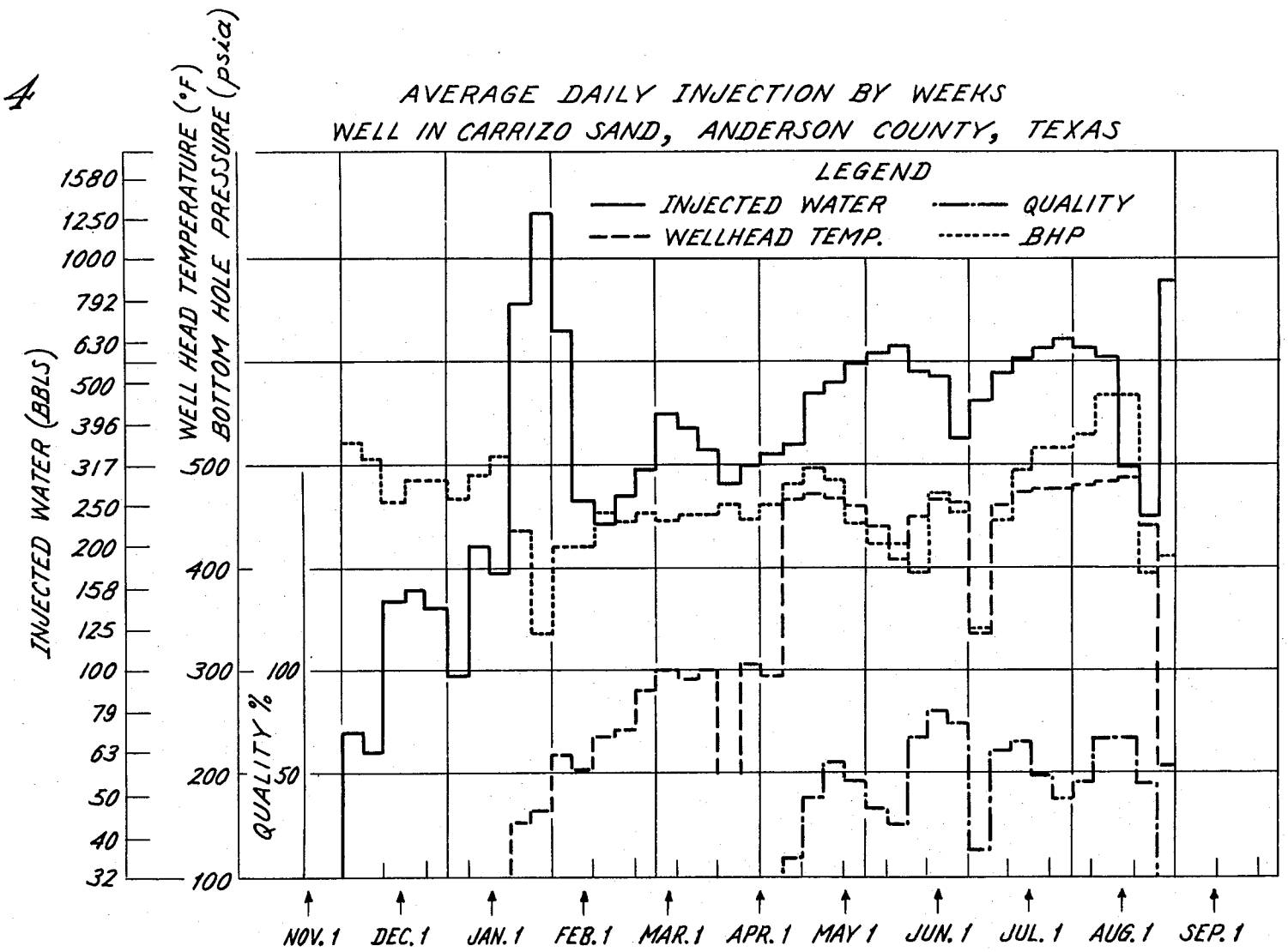
FIG. 4 is a graph plotting temperatures, pressures and quantities of injected fluids of the invention sequence carried out in an Anderson Count, Texas reservoir.

The twin goals of the field test were both accomplished. Improved communication between the injection and production wells resulted in a substantial increase in injectivity over steam only injection as well as a significant increase in oil recovery. Injection details, including injection periods, amount of injected water and steam, steam quality, bottom hole pressure and well head temperature are given in FIG. 4.

Thus, we have disclosed and demonstrated in laboratory experiments and field tests how injectivity is substantially improved and how a significantly greater quantity of oil may be recovered by the practice of the disclosed ambient temperature water-hot water-steam injection process. The invention should not be limited to the illustrations disclosed since many variations of this process will be apparent to persons skilled in the art of enhanced oil recovery without departing from the true spirit and scope of the invention. The mechanisms discussed in the foregoing description are offered only for the purpose of complete disclosure and not to restrict the invention to any particular theory of operation.

TABLE I

| Run. No. | 1 | 2 | 3 | 4 | 5 |
|---|---|---|---|---|---|
| Properties of Sand Packs | | | | | |
| Cell length, cm | 19.70 | 17.82 | 17.80 | 61.0 | 61.0 |
| Cross Sectional area, $cm^2$ | 9.48 | 9.48 | 9.46 | 27.1 | 27.1 |
| Bulk Volume, $cm^3$ | 167.9 | 168.9 | 168.5 | 1653 | 1653 |
| Matrix | Ground cores saturated with crude | Mixture of crushed core, water & crude | Mixture of crushed core, 1% KCL solution and crude | Crushed core saturated w/ water displaced crude | Crushed core saturated w/ water displaced crude |
| Pack density-Porosity fraction | 1.53 .43 | 1.85 .40 | 1.83 .42 | 1.81 .42 | 1.81 .43 |
| Liquid Permeability-Kur(md) | 1845 | 612 | 1340 | — | — |
| Initial Oil Volume; $cm^3$ | 11.7+52.5 | 26.6 | 26.5 | 596.6 | 590.1 |
| Initial Oil Saturation, fraction | .86 | .39 | .38 | .81 | .81 |
| Cold Water Floods | | | | | |
| Water Injection Rate, $cm^3/h$ | 120 | 120 | | 180 | 180 |
| Oil Produced, $cm^3$ | 16.1 | — | 178.2 | 162.7 | |
| Max Injection Pressure, kPa (psia) | 896(130) | 414(60) | | 4725(656) | 3185(462) |
| Remaining Oil Saturation, fraction | .64 | .39 | | .57 | .59 |
| Hot Water Floods | | | | | |
| Water Injection Rate, $cm^3/h$ | 120 | 120 | | 180 | |
| Water Temperature* °C. (F) | 82(180) | 93(200) | | 82(180) | |
| Oil Produced, $cm^3$ | 16.4 | 0.2 | | 139.4 | |
| Max Injection Pressure, kPa (psia) | 207(35) | 345(50) | | 480(70) | |
| Remaining Oil Saturation, fraction | .42 | .38 | | .38 | |
| Steam Floods | | | | | |
| Steam Injection Rate, g/h | 120 | 120 | 120 | 180 | 180 |
| Steam Temperature**, °C. (F) | 100(212) | 105(221) | 102(216) | 110(230) | 110(230) |
| Back Pressure, kPa (psia) | 101(14.7) | 101(14.7) | 101(14.7) | 101(14.7) | 101(14.7) |
| Oil Produced, $cm^3$ | 10.9 | 9.3 | 6.6 | 127.3 | 263.6 |
| Max Injection Pressure, kPa (psia) | 241(35) | 248(35) | 276(40) | 364(53) | 558(81) |
| Residual Oil Saturation, fraction | .227 | .243 | .28 | .22 | .228 |

*Avg cell temp during final pore volume injected
*Avg cell temp at steam breakthru

TABLE II

| | RESIDUAL OIL SATURATION |
|---|---|
| SEQUENCE INJECTION | |
| Example 6 | .22 |
| 7 | .24 |
| 8 | .25 |
| SEQUENCE INJECTION WITH COOLING STEP | |
| 9 | .29 |
| 10 | .30 |
| STEAM ONLY INJECTION | |
| 11 | .34 |
| 12 | .33 |

We claim:

1. A method for recovering hydrocarbons from a subterranean hydrocarbon-bearing formation penetrated by an injection well and a production well, which comprises:

(a) injecting water into the formation via an injection well at a temperature of about 10° C. to about 40° C. while recovering fluid at a production well;

(b) raising the temperature of the water to about 50° C. to about 100° C. while recovering fluid at the production well;

(c) ceasing injection of the water:

(d) injecting steam having a quality of about 10% to about 25% into the formation via an injection well while recovering fluid through the production well; and (e) gradually increasing the quality of the injected steam to a quality of about 65% to about 90%.

2. The method of claim 1 wherein the temperature of the water is gradually increased from about 10° C. to about 40° C. to a temperature of about 80° C. to about 100° C.

3. The method of claim 1 wherein the hydrocarbons to be recovered are highly viscous, having an API gravity of less than 20°.

* * * * *